United States Patent [19]

Stuckmann et al.

[11] Patent Number: 4,474,494

[45] Date of Patent: Oct. 2, 1984

[54] TUNNEL DRIVE SHIELD

[75] Inventors: Dieter Stuckmann, Selm; Hans-Jurgen Diederich, Lunen, both of Fed. Rep. of Germany

[73] Assignee: Gewerkschaft Eisenhutte Westfalia, Lunen, Fed. Rep. of Germany

[21] Appl. No.: 401,934

[22] Filed: Jul. 26, 1982

Related U.S. Application Data

[63] Continuation of Ser. No. 149,980, May 15, 1980.

[30] Foreign Application Priority Data

May 16, 1979 [DE] Fed. Rep. of Germany ..... 2919636

[51] Int. Cl.[3] ..... E21D 9/06

[52] U.S. Cl. ..... 405/143; 405/145

[58] Field of Search ..... 405/141, 143, 145, 146; 175/62, 71

[56] References Cited

U.S. PATENT DOCUMENTS 3,919,851 11/1975 Plourde ..... 405/143
3,926,005 12/1975 Foik ..... 405/143
4,022,029 5/1977 Jutte et al. ..... 405/146
4,118,938 10/1978 Unger et al. ..... 405/146 X
4,120,165 10/1978 Stuckmann et al. ..... 405/146 X
4,252,463 2/1981 Klysz ..... 405/145 X

FOREIGN PATENT DOCUMENTS 1225686 9/1966 Fed. Rep. of Germany ..... 405/141

*Primary Examiner*—David H. Corbin
*Assistant Examiner*—Nancy J. Stodola
*Attorney, Agent, or Firm*—Thompson, Birch, Gauthier & Samuels

[57] ABSTRACT

A tunnel drive shield has a front shield and a rear shield. The front shield is a knife shield, and the rear shield has a hood and a plurality of elongate members. The hood is connected to the front shield so as to be movable in all directions. Between the hood and the front shield (or the support frame for the knives of the front shield) is provided means for holding the two shields at a given angular setting. The connection between the two shields enables them to be angled relatively to each other to a limited extent in all directions, so that the original length of the entire drive shield is shortened, and the ability of the shield to negotiate curves is increased.

21 Claims, 5 Drawing Figures

TUNNEL DRIVE SHIELD

This application is a continuation of application Ser. No. 149,980, filed May 15 1980.

BACKGROUND OF THE INVENTION

This invention relates to a tunnel drive shield, in particular to a knife shield having a rear extension.

The conventional tunnel drive shield has a knife shield provided with a rear extension. The knife shield has a plurality of elongate members (or knives) arranged side-by-side on a common support frame. The knives can be advanced relative to the support frame, and define a generally cylindrical shield. The rear extension comprises tail extensions of the knives, the tail extensions being supported by a shield tail hood. The shield tail hood is generally part-cylindrical, and open towards the floor of the tunnel, so that a roof support mounted on the floor can be fitted in a temporary or final position.

Thus, the known tunnel drive shield permits the possibility of introducing roof support members into the shield tail hood. The roof support members may be, for example, tubbing rings. The arrangement ensures roof support in the critical region between the hood and the finally positioned roof support, when the shield tail hood is advanced. The use of a shield tail hood is particularly advantageous when providing a sprayed-concrete tunnel lining as described, for example, in U.S. Pat. No. 4,120,165.

By using a shield tail hood which is built on to the rear of a knife shield, the total length of the drive shield is considerably increased. Particularly in the case of smaller diameter shields, this results in an extremely unfavourable length/diameter ratio. which hinders the carrying out of vertical and horizontal control movements.

SUMMARY OF THE INVENTION

The present invention provides a tunnel drive shield having a generally cylindrical front shield, and a generally cylindrical rear shield, wherein the rear shield is connected to the front shield in such a manner as to permit the two shields to be angled relatively to one another to a limited extent in all directions.

Advantageously, the front shield is provided with a cutting edge at its front end. Preferably, the front shield has a plurality of elongate members arranged side-by-side parallel to the central longitudinal axis of the front shield, said elongate members being supported on, and movable relative to, a support frame, and said elongate members together forming a generally cylindrical shell. In this case, the rear shield may have a plurality of elongate members arranged side-by-side parallel to the central longitudinal axis of the rear shield, said elongate members being supported by a hood and together forming a generally cylindrical shell, and wherein the two shields are connected together by a connection between the support frame and the hood.

With this type of drive shield, it is possible to angle the front shield relative to the rear shield to a limited extent, and in all directions. This relative angling of the front and rear shields reduces the rigid length of the drive shield, and so considerably increases the ability of the shield as a whole to negotiate curves.

Conveniently, the elongate members of the front shield are relatively thick, profiled knives, and the elongate members of the rear shield are thin-walled, unprofiled metal sheets.

Preferably, the connection between the hood and the support frame includes means for holding the rear shield at a given angle relative to the front shield. Said holding means may comprise a plurality of hydraulic operating rams which are fitted between the support frame and the hood, each of said hydraulic operating rams being pivotably attached to both the support frame and the hood. Said holding means can be used for the active adjustment of the angular position between the front shield and the rear shield and/or for immobilising these parts in a given angular position. Advantageously, said hydraulic rams are equispaced about the circumference of the drive shield.

Where each elongate member of the front shield is provided with a hydraulic advance ram, the hydraulic advance rams being attached to their elongate members and to the support frame, the working stroke of the hydraulic operating rams may be less than that of the hydraulic advance rams. However, instead of hydraulic operating rams, use can also be made of other holding means, for example springs which urge the shield tail hood into a central position.

Advantageously, the connection between the hood and the support frame is a part-spherical bearing whose centre lies approximately on the central longitudinal axis of the drive shield. Preferably, the part-spherical bearing has a support member attached to the support frame, and bearing means attached to the hood, the support member and the bearing means having mutually-engaging, part-spherical bearing surfaces. In this case, the bearing means may comprise a plurality of equispaced bearing segments. The support member expediently forms a rearward extension of the support frame. When operating rams are used, these can be connected, by way of ball-and-socket joints, both to the support frame and the hood. Preferably, rigid backing members are provided for supporting the thin-walled elongate members of the rear shield in the region between the support frame and the hood.

Advantageously, rotation-preventing means are provided for preventing relative rotation between the support frame and the hood about the central longitudinal axis of the shield. Preferably, a plurality of rotation-preventing devices comprise said rotation-preventing means, each of said devices comprising a pair of tubular telescoped members, one member of each pair being attached to the support frame, the other member of each pair being attached to the hood.

In another embodiment, the hood comprises a plurality of hood segments which are movable relatively to one another, and each of which is advantageously connected to the support frame by means of a respective joint, the joints comprising said connection between the support frame and the hood. In this arrangement, a respective hydraulic operating ram may be associated with each hood segment. Preferably, each hood segment is provided with an integrally-formed, inwardly-extending radial lever arm, the hydraulic operating rams engaging the lever arms. In this case, the hydraulic operating rams may be connected to their lever arms so as to permit limited articulation therebetween.

Conveniently, each hood segment is associated with a respective pair of said elongate members of the rear shield.

Advantageously, the rear shield is open towards the floor of the tunnel. The elongate members of the front shield may be relatively thick, profiled knives, and the elongate members of the rear shield may be thin-walled unprofiled sheets which are sufficiently resilient to participate in the angular movements between the two shields. As the hood is so supported that it can execute limited movement in all directions, the elongate members of the rear shield are held on the nominal axis of the tunnel in dependence upon the setting of the operating rams, whereas the front shield (which does the actual cutting of the tunnel profile) can be made shorter, and readily participate in the control movement that is initiated. During this phase, the thin-walled elongate members of the rear shield readily adapt themselves to the control movements. The control of the elongate members of the front (knife) shield can be carried out, in the known manner, by pressurising the hydraulic advance rams which are backed by the support frame. By retracting and extending the hydraulic operating rams to varying degrees, the hood can be pivoted in any direction relative to the support frame, and can be immobilised in each position by hydraulically locking the operating rams.

BRIEF DESCRIPTION OF THE DRAWINGS

Two forms of tunnel drive shield, each constructed in accordance with the invention, will now be described, by way of example, with reference to the accompanying drawings, in which.

DESCRIPTION OF PREFERRED EMBODIMENTS

Figure 1:
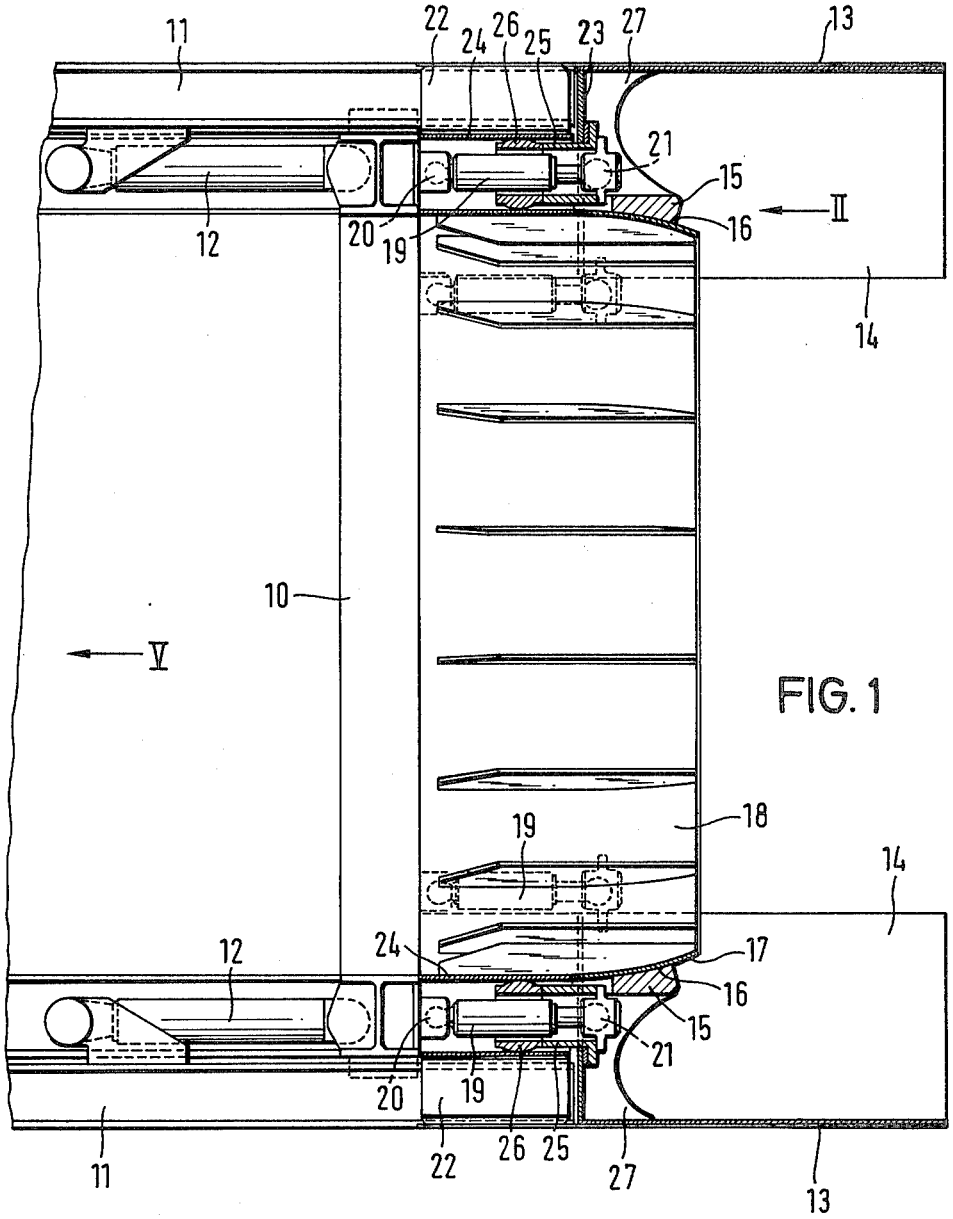
FIG. 1 is a part-sectional side elevation of the first form of shield.

Referring to the drawings, FIG. 1 shows a tunnel drive shield having a rigid support frame 10 (only the rear portion of which can be seen in FIG. 1) which supports a plurality of elongate members (or knives) 11. The knives 11 are arranged side-by-side parallel to the axis of the tunnel, and form a generally cylindrical shell. The knives 11 are supported and guided on the frame 10, and have cutting edges at their forward ends to attack and penetrate the working face when thrust forwards (in the direction of the arrow V) by a double-acting hydraulic rams 12. Each ram 12 may serve to advance a single knife 11, as illustrated, or a group of knives. Each ram 12 has its cylinder pivotally attached to the frame 10, and its piston rod pivotally attached to the associated knife 11. Extension of any one ram 12 will advance the associated knife 11 in the direction of the arrow V. During the driving of the tunnel, the rams 12 are extended one after another, the frame 10 and the stationary knives 11 (which are in frictional contact with the tunnel wall) collectively acting as an abutment for the ram being extended. When all the rams 12 have been extended in this way, all the knives 11 (and hence the entire cylindrical shell) are fully advanced. Thereafter, the rams 12 are retracted in unison to draw up the frame 10, the frictional contact between the knives 11 and the tunnel wall acting as an abutment for the advance of the frame.

This type of tunnel drive shield is known as a knife shield. The actual cutting of the tunnel is accomplished by means of a cutting machine (not shown) which operates within the shield.

In known manner, each of the knives 11 is provided with a tail extension 13 constituted by a thin-walled, unprofiled metal sheet having a wall-thickness of between 3 and 5 millimeters. Thus, the tail extensions 13 have a thickness which is considerably less than that of the profiled knives 11. The tail extensions 13 are supported by a common shield tail hood 14, which is constituted by a part-cylindrical sheet-metal jacket which is open towards the floor of the tunnel. A plurality of bearing segments 15 are secured to the inner wall of the hood 14, the bearing segments lying on a common pitch circle. Each bearing segment 15 has a part-spherical bearing face 16, the bearing faces all lying on a sphere whose centre lies on the central longitudinal axis of the shield. The bearing segments 15 are supported on a part-spherical bearing surface 17 of a support member 18. The support member 18 is secured to, and extends rearwardly of, the support frame 10. Thus, the support member 18 extends into cylindrical shell formed by the tail extensions 13. The centre of the sphere which contains the part-spherical bearing surface 17 also lies on the central longitudinal axis of the shield. Consequently, the shield tail hood 14 is supported on the support member 18 for limited pivotal movement in all directions. This enables the support frame 10 and the shield tail hood 14 to be angled relatively to one another.

A plurality of double-acting hydraulic rams 19 are positioned between the support frame 10 and the shield tail hood 14, each ram 19 being pivotally connected, by respective ball-and-socket joints 20 and 21, to the frame 10 and the hood 14. The rams 19 are equispaced around the support member 18, and lie roughly on the pitch circle of the rams 12. The working stroke of the rams 19 is considerably less than that of the rams 12. The rams 19 are used to angle the shield tail hood 14 relative to the support frame 10. The rams 19 can also be used to lock the hood 14 at any desired angle relative to the support frame 10, this being accomplished by hydraulically locking the rams 19.

Rigid backing members 22 are secured to, and extend rearwardly from, the support frame 10. The backing members 22 reinforce the thin-walled tail extensions 13 in the zone between the end wall 23 of the shield tail hood 14 and the rear end of the support frame 10. The rams 19 are positioned in the space between the backing members 22 and the shield tail hood 14. Each ram 19 is surrounded by a respective guide tube 24, the guide tubes being attached to, and extending rearwardly from, the support frame 10. Each guide tube 24 forms a guide for a respective tubular backing member 25, the tubular backing members surrounding the rams 19, and being secured to the end wall 23 of the shield tail hood 14. Each of the tubular backing members 25 is provided with part-spherical bearing surfaces 26 which engage the inner cylindrical wall of the associated guide tube 24. The tubular members 24 and 25 thus have adequate radial clearance, and so prevent relative rotation between the hood 14 and the support frame 10 about the axis of the shield. Nevertheless, the relative angling of the support frame 10 and the hood 14 is not impeded.

The rams 19 could be replaced by other setting devices, for example springs which bias the hood 14 towards its central position. Because of their inherent resilience, the thin-walled tail extensions 13 readily participate in the relative angular movements between the hood 14 and the support frame 10. The bearing segments 15 are welded to the hood 14 by means of sheet-metal webs 27. The backing members 22 are so formed that they extend axially, in a similar manner to the teeth of a "cylindrical comb", between the vertical webs of the knives 11. Thus, even when the knives 11 are advanced, the thin-walled tail extensions 13 are adequately supported in the zone between the hood 14 and the support frame 10, by the backing members 22, and do not deflect under the weight of the surrounding earth.

Figure 3:
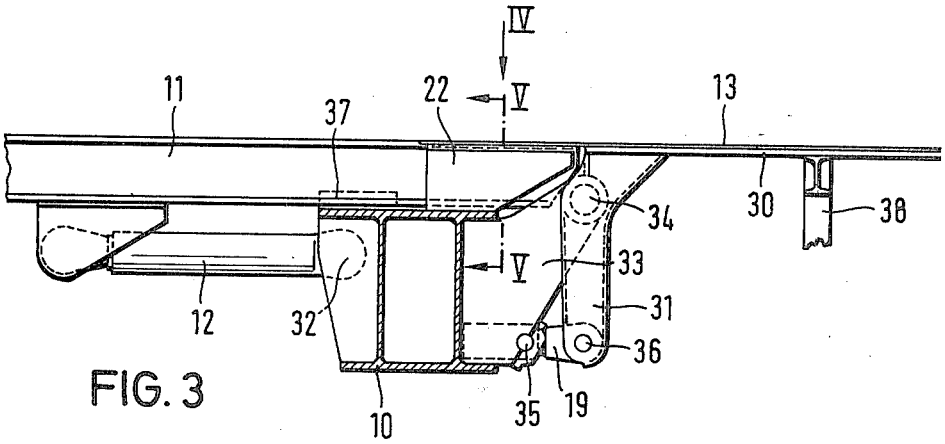
FIG. 3 is a part-sectional side elevation of part of the second form of shield.
Figure 4:
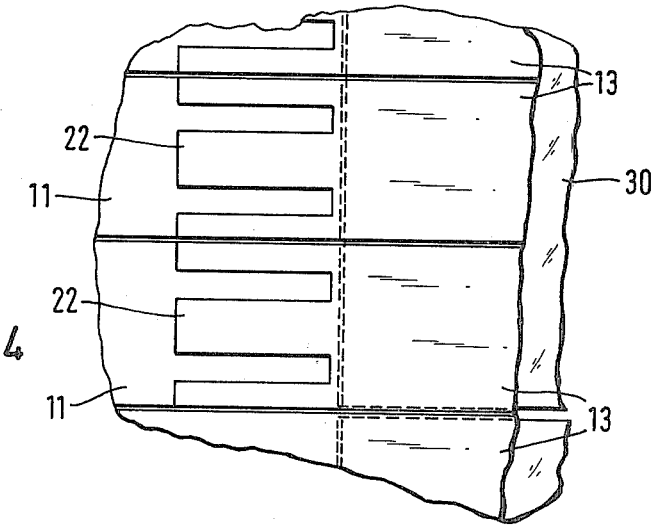
FIG. 4 is a view looking in the direction of the arrow IV of FIG. 3.
Figure 5:
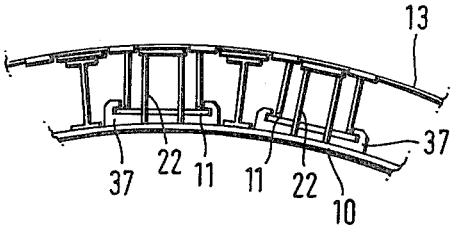
FIG. 5 is a cross-section taken on the line V—V of FIG. 3.

FIGS. 3 to 5 show a modified form of construction, in which the thin-walled tail extensions 13 are supported by a multi-part shield tail hood, which is constituted by a plurality of hood segments 30. The hood segments 30 define a part-cylindrical jacket which is open towards the floor of the tunnel. Each hood segment 30 has an integrally-formed, inwardly-extending, radial lever arm 31. As shown in FIG. 5, the profile knives 11 are guided in T-shaped grooves 37 formed in the support frame 10.

Each lever arm 31 is pivotably attached, at a respective pivot joint 34, to a respective bracket 33 attached to the rear end of the support frame 10. Each pivot joint 34 is such as to permit limited movement in all directions, so that the hood segments 30 and the support frame 10 can be angled relative to one another to a limited extent in all directions. The cylinders of the rams 12 which advance the knives 11 are pivotably attached, at 32, to the support frame 10 in the regions of the brackets 33. The rams 19, which angle the hood segments 30, engage the lever arms 31, the cylinder of each ram 19 being mounted in a swivel bearing 35 attached to the associated bracket 33, and the piston rod of that ram 19 being pivotably attached to the associated lever arm 31 by means of a respective link 36. One hood segment 30 has a width equal to that of two tail extensions 13, so that one hood segment provides support for a pair of adjacent tail extensions. Obviously, it would be possible to design the hood segments 30 so as to provide support for one tail extension 13, or for more than two tail extensions.

Figure 2:
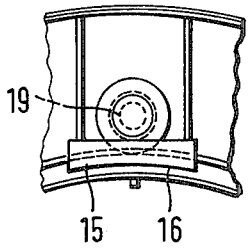
FIG. 2 is a view of part of the shield of FIG. 1 looking in the direction of the arrow II of FIG. 1.

The embodiment of FIGS. 3 to 5 also incorporates rigid backing members 22, these backing members being similar to those of the embodiment of FIGS. 1 and 2.

The multi-part formation of the shield tail hood of the embodiment of FIGS. 3 to 5 (and its multi-directional linkage with the support frame 10), increases the ability of this shield construction to negotiate curves. At the same time, the individual hood segments 30 can be thrust towards the tunnel wall, using the rams 19, to prevent undesirable deposits of earth.

FIG. 3 also shows roof-support elements 38 within the shield tail hood. These elements 38 form part of either a temporary or a permanent tunnel lining.

The apparatus operates in the following manner: if for example it becomes necessary to negotiate a turn to the right from the direction of arrow V in FIG. 1, then the rams 19 on the left side of arrow V will be extended more than those on the right side, with the result that the shield tail hood 14 carrying the knife tail extensions 13 will be angled relative to the frame 10 carrying the knives 11. Not only will the rams 19 impart this angular relationship, but they will also hold the hood 14 relative to the frame 10 until further adjustments are required.

We claim:

1. A tunnel drive shield comprising:

a generally cylindrical front shield having a plurality of elongate members arranged side-by-side parallel to the central longitudinal front shield axis, said elongate members being supported on, and movable relative to, a support frame;

a generally cylindrical rear shield having a plurality of elongate members arranged side-by-side parallel to the central longitudinal rear shield axis, said elongate members being supported by a hood;

means for interconnecting said support frame and said hood in a manner to permit the two shields to be angled relatively to one another to a limited extent in all directions, said means comprising a part-spherical bearing whose centre lies approximately on the central longitudinal axis of the drive shield; and a plurality of elongated adjusting means for angling and holding said shields relative to one another, said adjusting means extending between and being pivotally connected at their opposite ends to said shields, said adjusting means being longitudinally adjustable to selected settings to achieve said angling and being fixable at said settings to achieve said holding.

2. A drive shield according to claim 1, wherein the front shield is provided with a cutting edge at its front end.

3. A drive shield according to claim 1, wherein the elongate members of the front shield are relatively thick, profiled knives, and the elongate members of the rear shield are thin-walled, unprofiled metal sheets.

4. A drive shield according to claim 1, wherein adjusting said means comprises a plurality of hydraulic operating rams which are fitted between the support frame and the hood, each of said hydraulic operating rams being pivotably attached to both the support frame and the hood.

5. A drive shield according to claim 4, wherein said hydraulic rams are equispaced about the circumference of the drive shield.

6. A drive shield according to claim 4, wherein each elongate member of the front shield is provided with a hydraulic advance ram, the hydraulic advance rams being attached to their elongate members and to the support frame.

7. A drive shield according to claim 6, wherein the working stroke of the hydraulic operating rams is less than that of the hydraulic advance rams.

8. A drive shield according to claim 1, wherein the part-spherical bearing has a support member attached to the support frame, and bearing means attached to the hood, the support member and the bearing means having mutually-engaging, part-spherical bearing surfaces.

9. A drive shield according to claim 8, wherein the bearing means comprises a plurality of equispaced bearing segments.

10. A drive shield according to claim 8, wherein the support member forms a rearward extension of the support frame.

11. A drive shield according to claim 3, wherein rigid backing members are provided for supporting the thin-walled elongate members of the rear shield in the region between the support frame and the hood.

12. A drive shield according to claim 4, wherein the hydraulic operating rams are connected, by way of ball-and-socket joints, to both the support frame and the hood.

13. A drive shield according to claim 1, wherein the hood comprises a plurality of hood segments which are movable relatively to one another.

14. A drive shield according to claim 13, wherein each of the hood segments is connected to the support frame by means of a respective joint, the joints comprising said connection between the support frame and the hood.

15. A drive shield according to claim 13, wherein a respective hydraulic operating ram is associated with each hood segment.

16. A drive shield according to claim 15, wherein each hood segment is provided with an integrally-formed, inwardly-extending, radial lever arm, the hydraulic operating rams engaging the lever arms.

17. A drive shield according to claim 16, wherein the hydraulic operating rams are connected to their lever arms so as to permit limited articulation therebetween.

18. A drive shield according to claim 13, wherein each hood segment is associated with a respective pair of said elongate members of the rear shield.

19. A drive shield according to claim 1, wherein the rear shield is open towards the floor of the tunnel.

20. A tunnel drive shield comprising:

a generally cylindrical front shield having a plurality of elongate members arranged side-by-side parallel to the central longitudinal front shield axis, said elongate members being supported on, and moveable relative to, a support frame;

a generally cylindrical rear shield having a plurality of elongate members arranged side-by-side parallel to the central longitudinal rear shield axis, said elongate members being supported by a hood;

means for interconnecting said support frame and said hood in a manner to permit the two shields to be angled relatively to one another to a limited extent in all directions, a plurality of rotation-prevention devices for preventing rotation between the support frame and the hood about the central longitudinal axis of the shield, said rotation-prevention devices each comprising a pair of tubular telescoped members, one member of each pair being attached to the support frame, and the other member of each pair being attached to the hood; and a plurality of elongated adjusting means for angling and holding said shields relative to one another, said adjusting means extending between and being pivotally connected at their opposite ends to said shields, said adjusting means being longitudinally adjustable to selected settings to achieve said angling and being fixable at said settings to achieve said holding.

21. A drive shield according to claim 20, wherein the tubular members of each pair engage one another in such a manner as to permit limited articulation therebetween.

* * * * *